US009339134B1

(12) United States Patent
Poole et al.

(10) Patent No.: US 9,339,134 B1
(45) Date of Patent: May 17, 2016

(54) INSULATED COVERS FOR BEVERAGE CONTAINER

(76) Inventors: Robert R. Poole, Clayton, NC (US); Ray Reynolds, Knightdale, NC (US)

( * ) Notice: Subject to any disclaimer, the term of this patent is extended or adjusted under 35 U.S.C. 154(b) by 1065 days.

(21) Appl. No.: 12/697,361

(22) Filed: Feb. 1, 2010

(51) Int. Cl.

| | |
|---|---|
| ***A47G 23/02*** | (2006.01) |
| ***A47J 39/00*** | (2006.01) |
| ***A47J 41/00*** | (2006.01) |
| ***B65D 51/18*** | (2006.01) |
| ***B65D 81/38*** | (2006.01) |
| ***B65D 83/72*** | (2006.01) |
| ***B65D 25/00*** | (2006.01) |
| ***B65D 43/22*** | (2006.01) |
| ***B65D 43/24*** | (2006.01) |
| ***B65D 43/16*** | (2006.01) |
| ***B65D 77/00*** | (2006.01) |

(52) U.S. Cl.
CPC ..... *A47G 23/0233* (2013.01); *B65D 81/3879* (2013.01)

(58) Field of Classification Search
CPC ..... A47G 23/0233; A47G 2023/0291; B65D 43/24; B65D 81/3876; B65D 81/3879; B65D 2543/00379; Y10S 220/903
USPC ..... 220/592.16, 254.6, 255, 826, 831, 832, 220/739; 206/217
See application file for complete search history.

(56) References Cited

U.S. PATENT DOCUMENTS

| | | | | |
|---|---|---|---|---|
| 3,738,529 | A * | 6/1973 | Rose | 220/739 |
| 4,194,627 | A * | 3/1980 | Christensen | 206/545 |
| 4,573,631 | A * | 3/1986 | Reeves | 229/404 |
| 4,577,474 | A * | 3/1986 | Peterson | 62/457.4 |
| 4,872,577 | A | 10/1989 | Smith | |
| 5,609,277 | A | 3/1997 | McDonald | |
| 5,740,940 | A | 4/1998 | Weiss | |
| 6,039,207 | A | 3/2000 | Adamek | |
| 6,206,223 | B1 | 3/2001 | Wicker | |
| 6,349,846 | B1 | 2/2002 | Meza | |
| 6,412,637 | B1 * | 7/2002 | Saunders et al. | 206/541 |
| 6,662,454 | B2 * | 12/2003 | Harrold | 30/326 |
| 6,860,399 | B2 | 3/2005 | Reeves | |

* cited by examiner

*Primary Examiner* — Fenn Mathew
*Assistant Examiner* — Andrew T Kirsch
(74) *Attorney, Agent, or Firm* — Coats & Bennett, P.L.L.C.

(57) ABSTRACT

An insulated beverage holder comprises a cylindrical body to receive a beverage container and a lid hingedly connected to the body. The body comprises a bottom, cylindrical side wall, and open top. The lid comprises two sections. A first section of the lid is hingedly connected to the body. The second section of the lid is hingedly connected to the first section. The lid is movable between a closed position, partially open position, and fully open position.

14 Claims, 5 Drawing Sheets

INSULATED COVERS FOR BEVERAGE CONTAINER

BACKGROUND

The present invention relates generally to insulated covers for beverage containers and, more particularly, to insulated holders having a lid for enclosing the beverage container.

One of the most popular beverage containers in use today is the standard 12 oz. aluminum can. Aluminum cans provide a number of benefits, including rapid chilling of beverages because the aluminum is thermally conductive. For the same reason, beverages packaged in aluminum cans tend to warm up quickly when exposed to hot air. Thus, insulated beverage holders are frequently used to slow down heat transfer while the beverage is being consumed. One common type of beverage holder is the foam holder comprising a body with a cylindrical wall, bottom, and open top. The foam rubber on the bottom and sidewall of the can provides insulation and slows down heat transfer. However, the upper end of the can remains exposed to the air so that there is still substantial heat loss. Further, because the standard foam insulator does not have a lid, dust, debris, and insects may find their way into the beverage container.

SUMMARY

An insulated beverage holder comprises a cylindrical body to receive a beverage container and a lid hingedly connected to the body. The body comprises a bottom, cylindrical side wall, and open top. The lid comprises two sections. A first section of the lid is hingedly connected to the body. The second section of the lid is hingedly connected to the first section. The lid is movable between a closed position, partially open position, and fully open position. In the closed position, the lid encloses the open top of the cylindrical body. In the partially open position, the first section of the lid encloses a portion of the open top and the second portion of the lid is folded back against the first portion. In the fully open position, the lid is folded back against the side wall of the cylindrical body.

DETAILED DESCRIPTION

Figure 1:
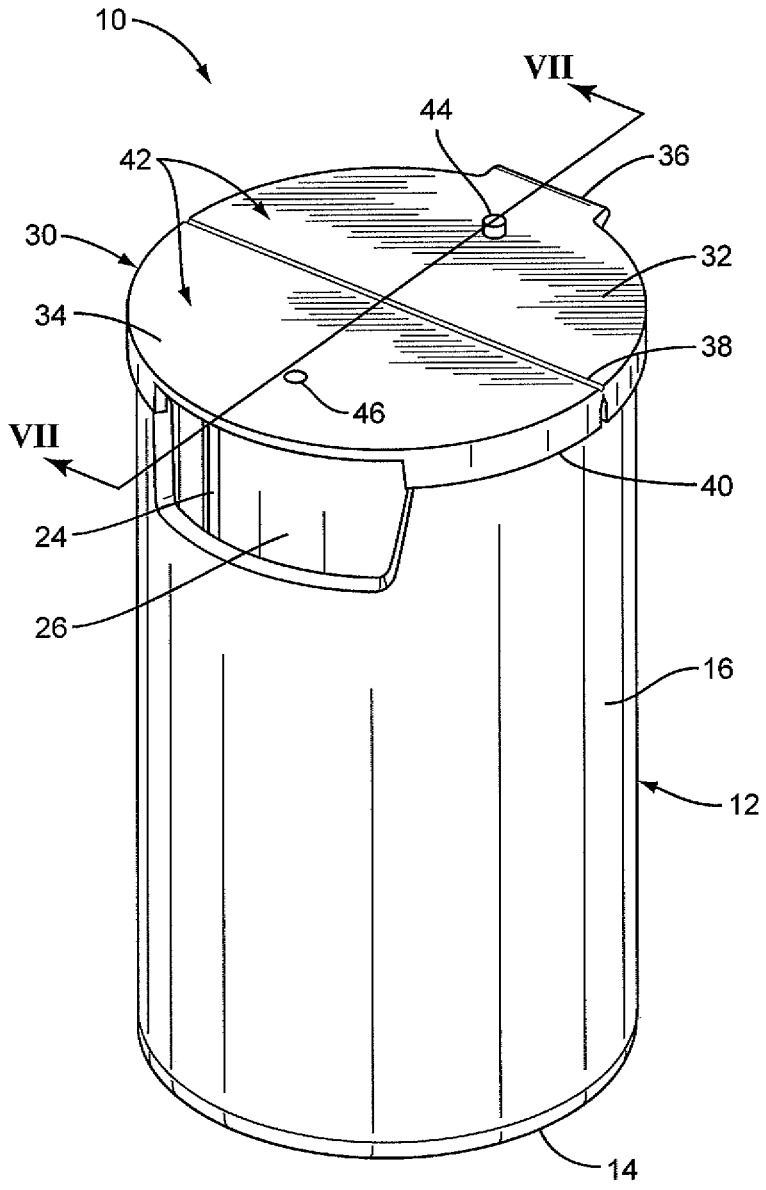
FIG. 1 is a perspective view of the insulated beverage holder with a lid in a closed position.

Referring now to the drawings a beverage holder according to one embodiment of the present invention is shown therein and indicated generally by the numeral 10. The beverage holder 10 comprises a generally cylindrical body 12 for receiving a standard size beverage container and a lid 30. The body 12 and lid 30 are made from a semi-rigid plastic material, such as polypropylene, polystyrene, ABS foam, and foam rubber.

The body 12 comprises a bottom 14, side wall 16, and open top 18. The bottom 14 includes a raised central portion 20 that contacts the bottom of the beverage container. A series of drain openings 22 allow condensation to drain from the beverage holder 10. The cylindrical side wall 16 is dimensioned to fit a standard beverage container, such as a 12 oz. aluminum can. The side wall 16 extends to a height above the top of the container. The diameter of the sidewall is slightly larger than the outside diameter of the can. Ribs 24 extend vertically on the inside surface of the side wall 16. Preferably, the side wall 16 includes three or more ribs 24. The ribs 24 provide a slight interference fit with the beverage container so that the container is held snuggly to prevent rotation of the container in the holder 10. A lip 28 is formed at the top edge of the side wall 16. As will be hereinafter described in greater detail, the lip 28 is engaged by the lid 30 when the lid 30 is closed so that the lid 30 is retained in a closed position.

The lid 30 comprises two sections, referred to herein as the back section 32 and the front section 34. The back and front sections 32, 34 of the lid 30 are joined by a live hinge 36. The function of the live hinge 36 will be described below. The back section 32 of the lid 30 is connected by a second hinge 38 to the side wall 16. The lid 30 has a generally-circular form and includes a lip 40 extending downward from its outer circumference. The lip 40 is broken where it intersects the live hinge 36 to allow folding of the lid 30.

Figure 2:
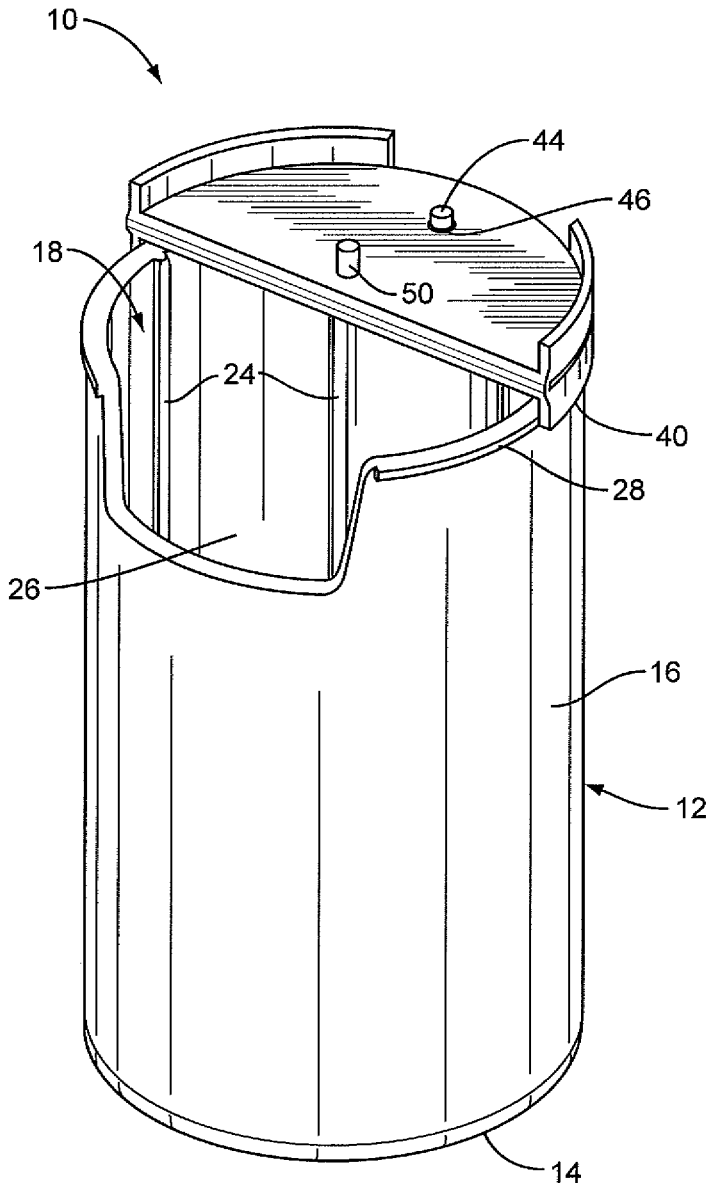
FIG. 2 is a perspective view of an insulated beverage holder with the lid in a partially open position.
Figure 4:
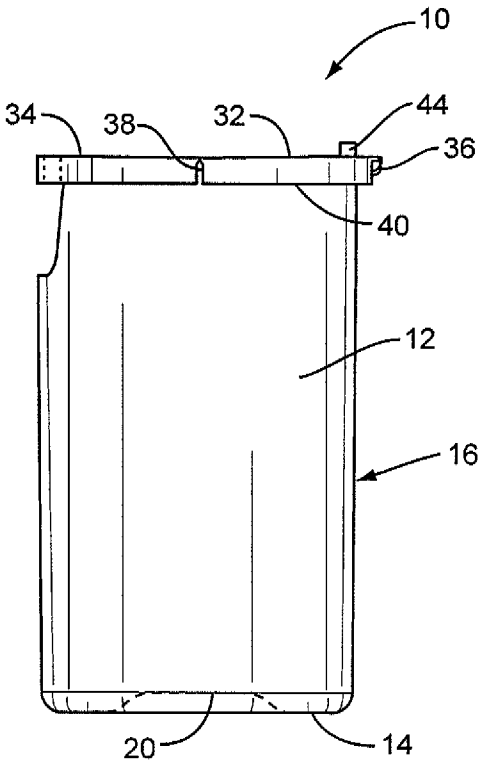
FIG. 4 is a side elevation of the beverage holder with the lid in a closed position.
Figure 5:
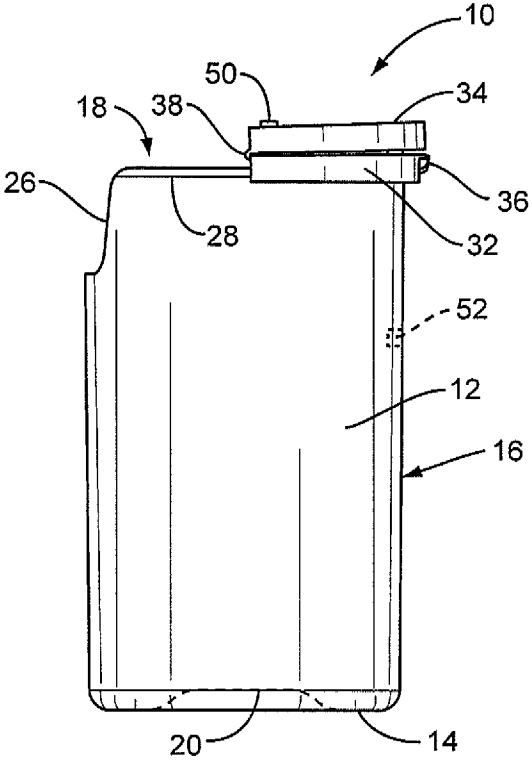
FIG. 5 is a side elevation of the beverage holder with the lid in a partially open position.
Figure 7:
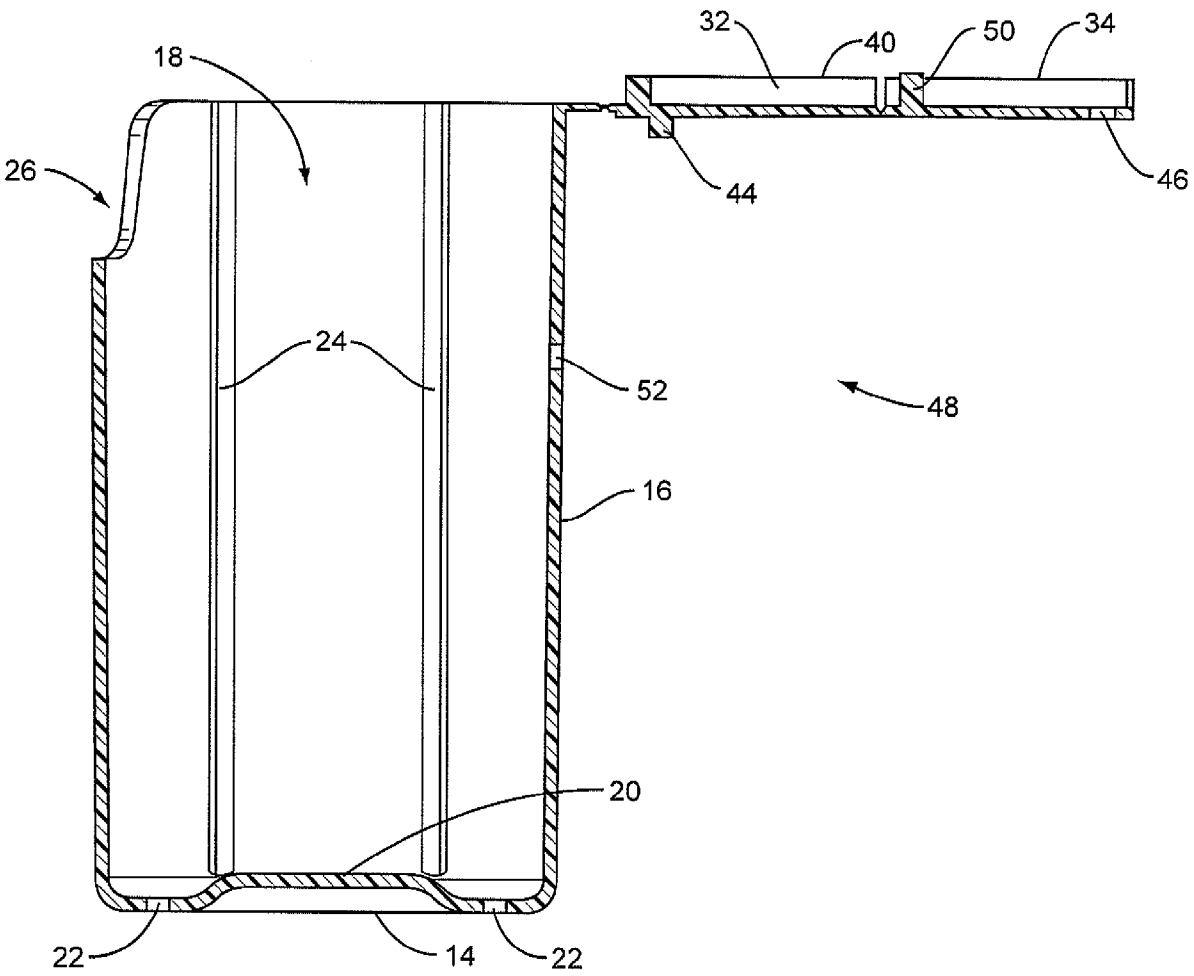
FIG. 7 is a section view of the beverage holder.

The lid 30 is movable between a closed position, a partially open position, and an open position. In the closed position, shown in FIGS. 1, 3, and 4, the back section 32 and front section 34 of the lid 30 lie in a plane and enclose the open top 18 of the body 12. Lip 40 on the lid 30 engages lip 28 on the side wall 16 to secure the lid 30 in the closed position. In the partially open position, shown in FIGS. 2 and 5, the front section 34 of the lid 30 folds back against the back section 32. A retaining mechanism 42 retains the lid 30 in the folded condition. In one exemplary embodiment, the retaining mechanism comprises a peg 44 formed on the back section 32, and a hole 46 on the front section 34. The peg 44 and hole 46 are sized to provide an interference fit. When the front section 34 is folded back against the back section 32, the peg 44 inserts into the hole 46 to secure the lid 30 in the folded condition. However, those skilled in the art will appreciate that other types of retaining mechanisms could also be used. For example, the retaining mechanism may comprise locking tabs, latches, hooks, magnets, VELCRO-type fasteners, or other similar means to retain the back and front sections 32, 34 of the lid 30 in the folded condition.

Figure 3:
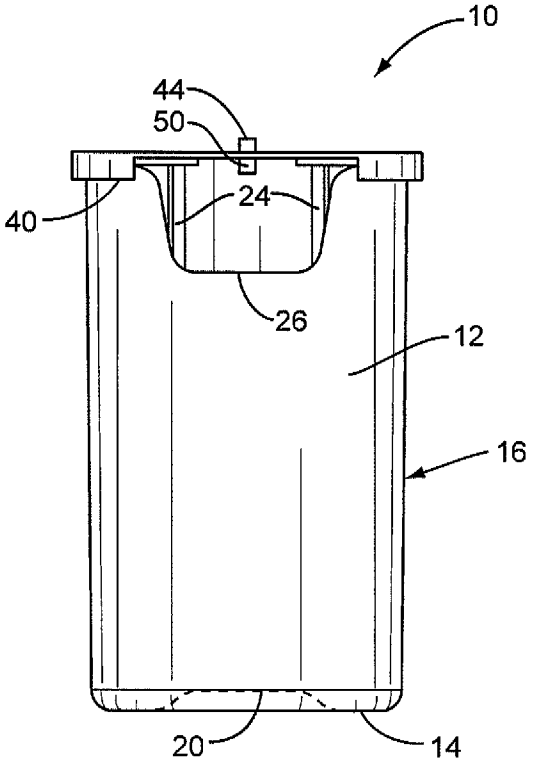
FIG. 3 is a front elevation of the beverage holder with the lid in a closed position.
Figure 6:
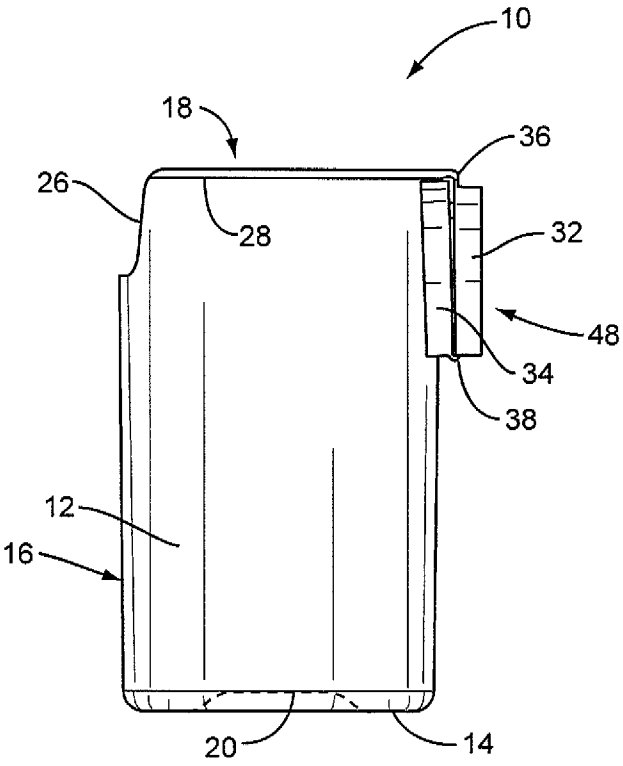
FIG. 6 is a side elevation of the beverage holder with the lid in the open position.

In the open position, shown in FIGS. 3 and 6, the lid 30 is folded back against the side wall 16. Note that the lid 30 remains in a folded condition. A second retaining mechanism 48 holds the lid 30 in the open position. In one exemplary embodiment, the second retaining mechanism 48 comprises a peg 50 on an inside surface of the front section 34 of the lid 30, and a mating hole 52 in the side wall 16. When the lid 30 is folded back against the side wall 16, the peg 50 inserts into the hole 52 to secure the lid in the open position. However, those skilled in the art will appreciate that other types of retaining mechanisms could also be used. For example, the retaining mechanism may comprise locking tabs, latches, hooks, magnets, VELCRO-type fasteners, or other similar means to retain the back and front sections 32, 34 of the lid 30 in the open position.

The present invention may, of course, be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An insulated holder for receiving a beverage container, said insulated holder comprising:

a body having a bottom, cylindrical sidewall, and open top, said sidewall dimensioned to receive a beverage container of predetermined size and shape;

a lid including a first section hingedly connected to the sidewall of the body and a second section hingedly connected to the first section such that the lid is movable between an open position in which the open top of the body is exposed, a closed position in which the lid encloses the open top of the body and the first and second sections of the lid lie in a plane, and a partially open position in which the first section of the lid encloses a portion of the open top and the second portion of the lid is folded back against the first portion.

2. The insulated holder of claim 1 wherein the sidewall of the body extends to a height above the top of a beverage container received in the body.

3. The insulated holder of claim 1 further comprising a cut-out disposed along a top edge of the sidewall to provide access to an opening in the beverage container.

4. The insulated holder of claim 1 further comprising a first retaining mechanism to retain the second section of the lid in a folded position against the first section of the lid when the lid is in the partially open position.

5. The insulated holder of claim 4 wherein the first retaining mechanism comprises a first peg in one section of the lid and a first hole in the other section of the lid to receive the first peg.

6. The insulated holder of claim 4 further comprising a second retaining mechanism to retain the lid in a folded position against the sidewall of the body when the lid is in the open position.

7. The insulated holder of claim 6 wherein the second retaining mechanism comprises a second peg in either the lid or the body and a second hole in the other of the lid and the body to receive the second peg.

8. The insulated holder of claim 1 further comprising ribs on an inner surface of the sidewall to frictionally engage the beverage container when the beverage container is inserted into the insulated holder.

9. An insulated holder for receiving a beverage container, said insulated holder comprising:

a body having a bottom, a sidewall, and open top, said sidewall dimensioned to receive a beverage container of predetermined size and shape;

a lid configured to be secured to the open top of the body, said lid including a first section and a second section hingedly connected to the first section such that the second section is movable when the lid is secured to the body between a closed position in which the first and second sections enclose the open top and a partially open position in which the first section of the lid partially encloses the open top and the second section of the lid is folded back against the first section.

10. The insulated holder of claim 9 wherein the sidewall of the body extends to a height above the top of a beverage container received in the body.

11. The insulated holder of claim 9 further comprising a cut-out disposed along a top edge of the sidewall to provide access to an opening in the beverage container.

12. The insulated holder of claim 9 further comprising a first retaining mechanism to retain the second section of the lid in a folded position against the first section of the lid when the lid is in the partially open position.

13. The insulated holder of claim 12 wherein the first retaining mechanism comprises a first peg in one section of the lid and a first hole in the other section of the lid to receive the first peg.

14. The insulated holder of claim 9 further comprising ribs on an inner surface of the sidewall to frictionally engage the beverage container when the beverage container is inserted into the insulated holder.

* * * * *